US008667642B2

(12) United States Patent
Krebs

(10) Patent No.: US 8,667,642 B2
(45) Date of Patent: Mar. 11, 2014

(54) VACUUM ACCESSORY TOOL

(75) Inventor: Alan J. Krebs, Pierson, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 755 days.

(21) Appl. No.: 12/726,373

(22) Filed: Mar. 18, 2010

(65) Prior Publication Data

US 2010/0236017 A1 Sep. 23, 2010

Related U.S. Application Data

(60) Provisional application No. 61/161,935, filed on Mar. 20, 2009.

(51) Int. Cl.
*A47L 9/06* (2006.01)

(52) U.S. Cl.
CPC ..... *A47L 9/0666* (2013.01)
USPC ..... 15/398; 15/401

(58) Field of Classification Search
USPC ..... 15/367, 364, 365, 398, 399, 401, 373
See application file for complete search history.

(56) References Cited

U.S. PATENT DOCUMENTS

| | | | | |
|---|---|---|---|---|
| 1,907,370 | A | 5/1933 | Schoeller | |
| 2,703,903 | A * | 3/1955 | Faith-Ell | 15/365 |
| 3,072,951 | A * | 1/1963 | Kelnhofer | 15/369 |
| 4,864,681 | A * | 9/1989 | Hult et al. | 15/367 |
| 4,888,852 | A | 12/1989 | Varin | |
| 5,524,575 | A | 6/1996 | Lennon | |
| 5,613,271 | A * | 3/1997 | Thomas | 15/321 |
| 5,930,862 | A | 8/1999 | Garrett | |
| 6,029,311 | A * | 2/2000 | Scanni et al. | 15/344 |
| 6,279,198 | B1 * | 8/2001 | Martin et al. | 15/393 |
| 2002/0170140 | A1 | 11/2002 | Diaz et al. | |
| 2006/0248680 | A1 | 11/2006 | Heidenga et al. | |
| 2007/0143954 | A1 * | 6/2007 | Graham et al. | 15/364 |

FOREIGN PATENT DOCUMENTS

| | | | |
|---|---|---|---|
| EP | 1927310 | A1 | 6/2008 |
| EP | 2218385 | A2 | 8/2010 |
| FR | 2792817 | A1 | 11/2000 |

* cited by examiner

*Primary Examiner* — William Gilbert
(74) *Attorney, Agent, or Firm* — McGarry Bair PC

(57) ABSTRACT

An accessory tool for use with a suction source has a housing having a suction outlet and a suction nozzle. A hair collection element is pivotally mounted within the suction nozzle for movement between a forward position and a rearward position. The hair collection element can be in the form of a blade and a hair collecting material mounted to the blade for contacting a surface to be cleaned. Alternatively, an elastomeric material can be coated onto the blade or form the blade itself. Also, the hair collecting material can be formed into the form of the blade without any support other than a rod for mounting the fabric.

14 Claims, 4 Drawing Sheets

VACUUM ACCESSORY TOOL

CROSS REFERENCE TO RELATED APPLICATIONS

This application claims priority to U.S. Provisional Patent Application Ser. No. 61/161,935, filed Mar. 20, 2009, which is incorporated herein in its entirety.

BACKGROUND OF THE INVENTION

1. Field of the Invention

The invention relates to vacuum cleaning accessory tools adapted to remove pet hair from carpet and other fabric surfaces.

2. Description of the Related Art

Pet hair from shedding animals, such as dogs and cats, can easily become trapped in fabrics, such as carpets, rugs, upholstered furniture, and other similar items. While a traditional vacuum cleaner can remove some of the hair, it is common for much of the hair to become embedded and trapped within the fibers of the fabric thereby preventing effective and complete removal by vacuum cleaner suction alone.

Heretofore, carpet rakes, such as the device disclosed in U.S. Pat. No. 5,930,862 to Garret have been used to rake carpets by pulling the rake over the surface of the carpet to collect hair on the carpet and gather it into a pile. Typically, these carpet rakes include a plurality of bristles to rake the hair on the carpet towards the user of the rake, wherein the user must then pick up the pile of collected hair.

U.S. Pat. No. 1,907,370 to Schoeller discloses a hair and thread gathering nozzle attachment for a vacuum cleaner. The nozzle comprises a wood or metal slider with longitudinal air passages that lead to a suction aperture. The nozzle attachment further comprises strips of non-felting material, such as crepe rubber, that loosens hairs and threads during movement of the nozzle attachment. The hairs and threads are removed through the suction apertures.

U.S. Pat. No. 4,888,852 to Varin discloses a vacuum cleaner suction head having a stationary brush and an arcuate channel in which is mounted a removable blade covered with a thread-pickup cloth whose fibers are directed towards a suction aperture. The blade is removable, and is retractable in one embodiment.

U.S. Patent Application Publication No. 2002/0170140 to Diaz et al. discloses a vacuum cleaner adapter comprising a bristle wheel with bristles with straight ends for removing hair and animal fur from rugs and carpets. The bristles can be made of a metal or alloy or of a natural or synthetic organic, polymeric, elastomeric, or composite material, such as nylon, rubber, or the like.

SUMMARY OF THE INVENTION

According to the invention, an accessory tool for use with a suction source comprises a housing comprising a suction outlet and a suction nozzle opening defined by a rim on an underside of the housing, the suction outlet being adapted to be coupled to the suction source; and a hair collection element pivotally mounted within the suction nozzle opening for movement between a forward position and a rearward position and adapted to contact a surface to be cleaned and to collect hair from the surface during movement of the suction nozzle along the surface at least in one direction. The hair collection element is positioned within the suction nozzle opening so that the suction nozzle opening is in fluid communication with the suction outlet forwardly and rearwardly of the hair collection element regardless of the position of the hair collection element. In addition, the hair collecting element is configured to pick up hair during one of the forward and backward strokes and is adapted to release hair picked up by the hair collection element during the other of the forward and backward stroke for ingestion by the suction nozzle. Further, the suction nozzle is configured to ingest the released hair during the other of the forward and backward stroke.

In one embodiment, the hair collection element has a thin cross-sectional profile and a longitudinal axis along its length, and the hair collection element is mounted for pivotal movement about the longitudinal axis. In a preferred embodiment, the longitudinal axis of the hair collection element is along one longitudinal edge of the profile so that the hair collection element is mounted substantially vertically within the suction nozzle opening. In addition, the hair collection element forward position is an acute forward angle during a backward stroke of the accessory tool and the rearward position is an acute backward angle during a forward stroke. Still further, the hair collection element can be configured within the suction nozzle to project beneath the rim of the suction nozzle in both the forward and backward strokes.

In another embodiment, the hair collection element can include a strip of directional fabric adapted to collect hair from the surface to be cleaned when the accessory tool is moved across the surface to be cleaned in a first direction and adapted to deposit collected hair from the surface to be cleaned for ingestion by the suction nozzle opening when the accessory tool is moved across the surface to be cleaned in a second direction. In addition, the hair collecting material can be adapted to pick up hair during one of the forward and backward strokes and can be adapted to release hair picked up by the hair collection material during the other of the forward and backward stroke for ingestion by the suction nozzle.

In one embodiment, the strip of directional fabric is mounted to a surface of a support that has the form of a blade. In another embodiment, the direction fabric can be folded along a length thereof in the form of a blade.

In another embodiment, the hair collection element can include an elastomeric material that is adapted to collect hair from the surface during movement of the suction nozzle along the surface at least in one direction. In this embodiment, the hair collecting element can include a support in the form of a blade and the elastomeric material can be coated onto a surface of the support. Alternatively, the elastomeric material can form the hair collection element.

Further according to the invention, an accessory tool for use with a suction source comprises a housing with a suction outlet and a suction nozzle opening defined by a rim on an underside of the housing, and the suction outlet is adapted to be coupled to the suction source. A hair collection element is mounted within the suction nozzle opening and comprises a hair-collecting material that is adapted to contact a surface to be cleaned and to pick up hair from the surface during one of the forward and backward strokes of the suction nozzle along the surface and that is adapted to release hair picked up by the hair collecting material during the other of the forward and backward strokes of the suction nozzle for ingestion by the suction nozzle, the hair collection element is positioned within the suction nozzle opening so that the suction nozzle opening is in fluid communication with the suction outlet forwardly and rearwardly of the hair collection element regardless of the position of the hair collection element. The hair collection element has a thin cross-sectional profile and a longitudinal axis along its length, and the hair collection element is mounted substantially vertically within the suction nozzle opening. Further, the suction nozzle is configured to ingest the released hair during the other of the forward and backward strokes.

DESCRIPTION OF THE PREFERRED EMBODIMENT

Figure 1:
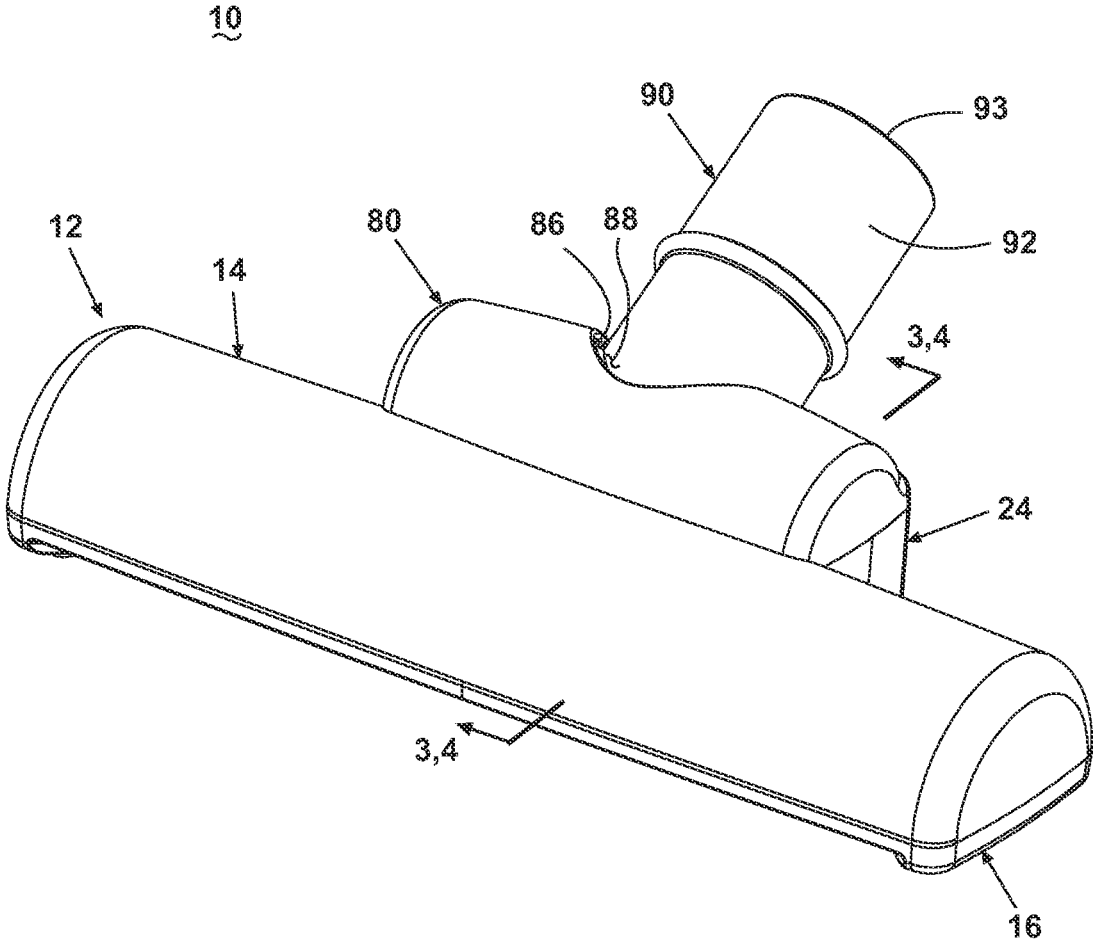
FIG. 1 is a front perspective view of a vacuum accessory tool according to the invention.
Figure 2:
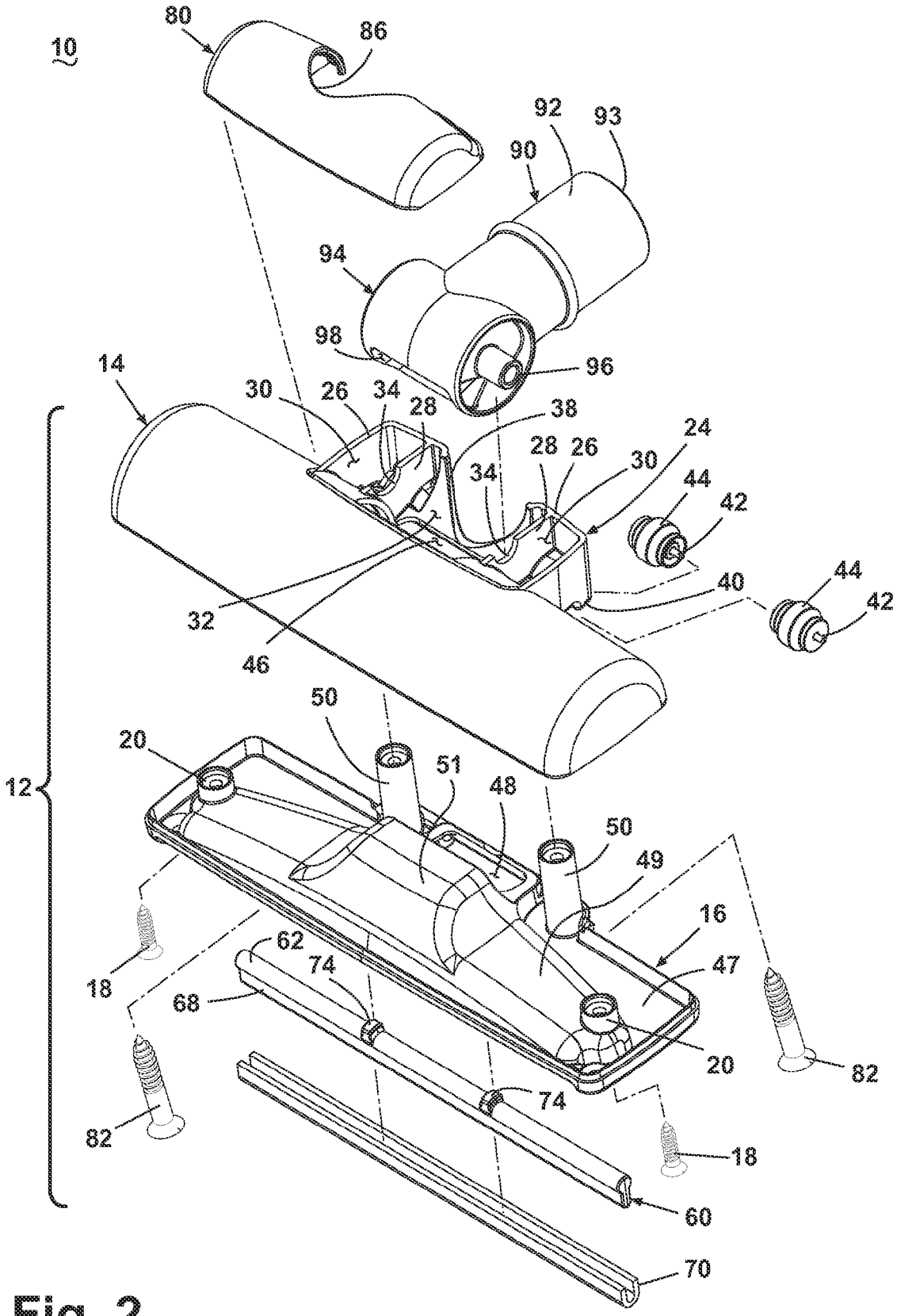
FIG. 2 is an exploded perspective view of the vacuum accessory tool of FIG. 1.

Referring to the drawings and in particular to FIGS. 1 and 2, a vacuum accessory tool 10 according to the invention comprises a nozzle body 12 including an upper housing 14 and a lower housing 16. The upper housing 14 and lower housing 16 are secured together using conventional fasteners, such as screws 18. The screws 18 are inserted through bosses 20 formed on opposite ends of the lower housing 16 and are seated into a corresponding second set of bosses (not shown) that extend downwardly from a lower surface of the upper housing 14. Alternatively, the upper housing 14 and lower housing 16 can be coupled in any suitable manner, such as by a snap fit, an adhesive, or the like.

The upper housing 14 further comprises a coupling housing 24 integrally formed at a rear portion thereof. The coupling housing 24 is generally rectangular in shape and has an open top at an upper edge 26. Two divider walls 28 of the coupling housing 24 have a height substantially equal to that of the coupling housing 24 and extend from the rear to the front of the coupling housing 24. The divider walls 28 divide the interior of the coupling housing 24, defining two boss-receiving recesses 30 and a coupling recess 32 located therebetween. Each of the divider walls 28 further comprises a semi-circular notch 34 in an upper edge. A boss-receiving opening 36 (FIG. 3) is formed through a lower wall of each of the boss-receiving recesses 30. A cutout 38 is formed in a rear of the coupling housing 24. A pair of notches 40 are formed on opposite sides of a lower surface of the coupling housing 24, toward the rear thereof. Each of the notches 40 is adapted to receive a wheel axle 42 for rotatably mounting a corresponding rear wheel 44 to the coupling housing 24. The upper housing 14 further comprises a suction opening 46 adjacent to a front of the coupling housing 24.

The lower housing 16 also has a suction opening 48 formed in a rear thereof and is adapted to be positioned adjacent the suction opening 46 in the upper housing 14. The lower housing 16 includes a pair of bosses 50 that extend through the lower housing 16 and upward. The bosses 50 are adapted for receipt by the boss-receiving openings 36 (FIG. 3) located in the upper housing 14. Glide pads 52 (FIG. 3) are formed integral to the lower housing 16 and are positioned on opposite ends and on a lower front portion thereof. The glide pads 52 comprise rounded protrusions that extend downwardly from the lower housing 16. The glide pads 52 are adapted to support the accessory tool 10 for gliding across a surface to be cleaned. Alternatively, small wheels can replaced the glide pads to enhance facile gliding of the accessory tool 10 across the cleaning surface.

A suction nozzle 54 (FIG. 3) is formed on an underside of the lower housing 16 and is defined by a rim 47 on an underside of the housing, upper side channels 49 and central channel 51. The suction nozzle 54 is adapted to provide suction to the surface being cleaned. Within the assembled vacuum accessory tool 10, the suction nozzle 54 is in fluid communication with the suction opening 48, which is in turn in fluid communication with the suction opening 46 in the upper housing 14. Together the suction nozzle 54, suction opening 48, and suction opening 46 form a portion of a suction path therethrough.

Figure 3:
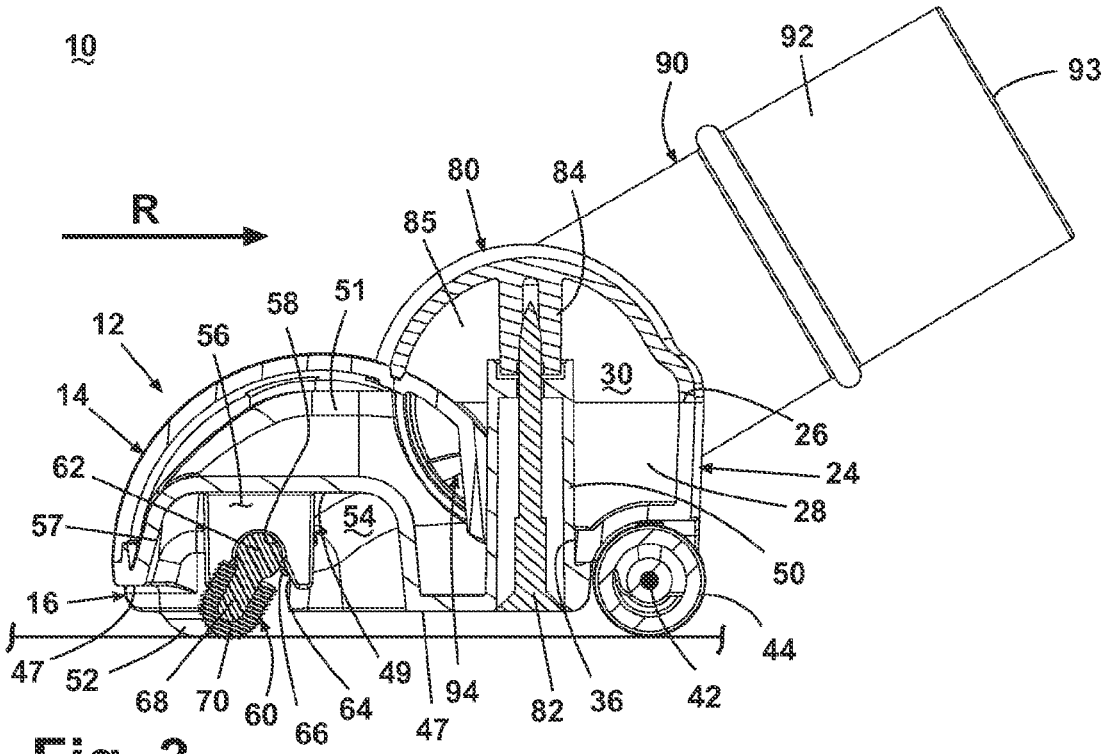
FIG. 3 is a cross-sectional view of the vacuum accessory tool of FIG. 1 taken along line 3-3 with the hair collection element oriented to illustrate a rearward pull stroke.
Figure 4:
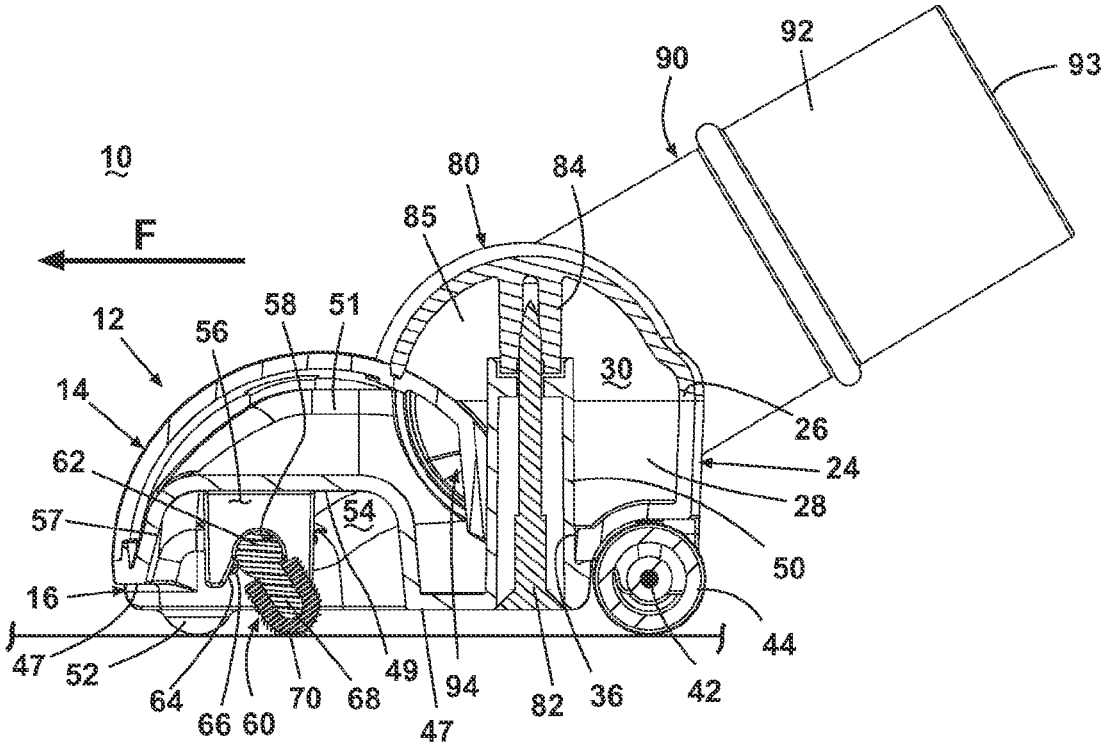
FIG. 4 is a cross-sectional view of the vacuum accessory tool of FIG. 1 taken along line 3-3 with the hair collection element oriented to illustrate a forward push stroke.

Referring now to FIGS. 3-4, a plurality of mounting ribs 56 extend downwardly within the interior of the suction nozzle 54 and are oriented substantially perpendicular to a front nozzle wall 57. The lower portion of the mounting ribs 56 comprise mounting slots 58. The mounting slots 58 are adapted to collectively and pivotally mount a hair collection element 60 to the lower housing 16 for movement between a forward position and a rearward position. The mounting slots 58 are adapted to receive a portion of an elongated cylindrical support 62 of the hair collection element 60. The elongated cylindrical support 62 extends substantially across the width of the suction nozzle 54 and through the mounting slots 58. As illustrated in FIGS. 3 and 4, the hair collection element 60 is positioned within the opening of the suction nozzle 54 so that the suction nozzle opening is in fluid communication with the suction opening 46 forwardly and rearwardly of the hair connection element 60 regardless of the position of the hair collection element.

Each mounting slot 58 further comprises mutually opposed angular stops 64 and detents 66 formed at both and front and rear surfaces of the mounting slot 58. The opposed angular stops 64 are adapted to selectively contact opposite sides of a blade 68 that extends downwardly from the elongated cylindrical support 62, best seen in FIG. 2. The angular stops 64 comprise angled lower portions of the mounting slots 58 that are angled away from a center line of the mounting slots 58 as they extend downward. The angular stops 64 are adapted to limit pivotal movement of the hair collection element 60 within the suction nozzle 54. Specifically, the angular stops 64 define an angular pivot range through which the hair collection element 60 can pivot. The blade 68 contacts the angular stops 64 at the forward or backward pivot limits and thus cannot pivot further. The angular pivot range can be about 130 degrees, but an acceptable range for the angular pivot range can be a range of 90 to 150 degrees. When the angular pivot range is within the preferred range, intermittent catching of the hair collection element 60 on the surface to be cleaned (also known as 'chatter') is minimized during use of the vacuum accessory tool 10. As illustrated in FIGS. 3 and 4, the hair collection element 60 is positioned at a forward and rearward pivot limit of the angular pivot range, defining the angular pivot range therebetween.

Each detent 66 comprises a relatively small protrusion located at a lower portion of the mounting slots 58. The detents 66 are positioned above the angular stops 64 and extend toward the center line of the mounting slot 58. The opposing detents 66 are configured to retain the elongated cylindrical support 62 of the hair collection element 60 within the mounting slots 58 by upwardly biasing the elongated cylindrical support 62 into the mounting slots 58. The elongated cylindrical support 62 is free to pivot about a longitudinal axis thereof, and the detents 66 are configured to permit easy installation and removal of the hair collection element 60 for initial assembly or replacement.

When mounted in the mounting slot 58, the hair collection element 60 is oriented transversely within the suction nozzle 54 and is positioned forward of the suction opening 46 in the upper housing 14. Referring back to FIG. 2, the hair collection element 60 comprises the elongated cylindrical support 62 and the blade 68 portion that projects radially from a lower surface of the elongated cylindrical support 62. Guide ribs 74 protrude from an upper surface of the cylindrical support 62 opposite the blade 68. Each of the guide ribs 74 is oriented perpendicular to the longitudinal axis of the elongated cylindrical support 62 and is configured to nest against an innermost surface of each of the innermost mounting ribs 56 of the lower housing 16 to limit transverse axial movement of the hair collection element 60.

The hair collection element 60 further comprises a hair collecting material 70 at least partially covering the blade 68 as illustrated in FIGS. 3-4. The hair collecting material 70 at least partially covering the blade 68 is U-shaped and substantially surrounds three sides of the blade 68. The hair collecting material 70 can comprise a commercially available lint removal material, often referred to as a 'directional fabric', such as that typically found on commercially-available lint brushes. The hair collecting material 70 collects hair and/or other small debris when drawn across a fabric surface in a first direction. When the hair collecting material 70 is drawn across a fabric surface in the opposite direction, hair and/or other small debris present on the hair collecting material 70 is released onto the fabric surface in a convenient pile. Accordingly, as shown in FIGS. 3 and 4, the hair collecting material 70 is attached to the blade 68 portion and oriented so that the hair collection element 60 can collect hair and/or other small debris when the accessory tool 10 is moved in a rearward direction "R" across the surface to be cleaned and will not collect hair and/or other small debris when the accessory tool 10 is moved in a forward direction "F" across a surface to be cleaned.

Figure 5:
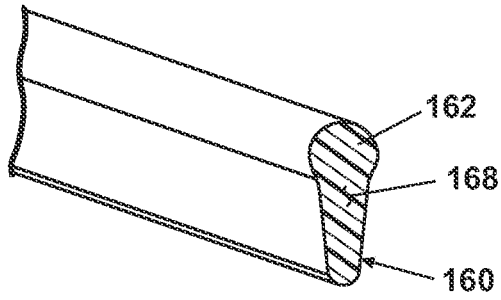
FIG. 5 is a partial perspective view of a hair collection element according to a second embodiment of the invention.

The hair collection element 60 can comprise alternate configurations described hereinafter wherein like elements are identified by like reference numerals incremented by 100. For example, in another embodiment shown in FIG. 5, the hair collection element 160 is the blade 168 and the blade makes direct contact with the surface to be cleaned. The blade 168 can comprise a unitary member of molded elastomeric material that is adapted to collect hair. The elastomeric material can comprise silicone or a conventional thermoplastic elastomer, for example.

Figure 6:
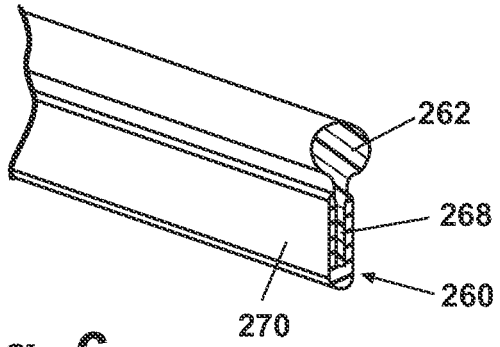
FIG. 6 is a partial perspective view of a hair collection element according to a third embodiment of the invention.

In an alternate embodiment shown in FIG. 6 wherein like elements are identified by like reference numerals incremented by 200, the hair collection element 260 comprises a semi-rigid blade 268 that is surrounded by a hair collecting material 270, which comprises a U-shaped resilient elastomeric material. The elastomeric hair collecting material 270 can be bonded to the blade 268 by a variety of conventional attachment means such as adhesive, overmolding, or mechanical engagement. Furthermore, the lower portion of the blade 268 can comprise a reduced cross-sectional thickness that is adapted to receive the elastomeric hair collecting material 270.

Figure 7:
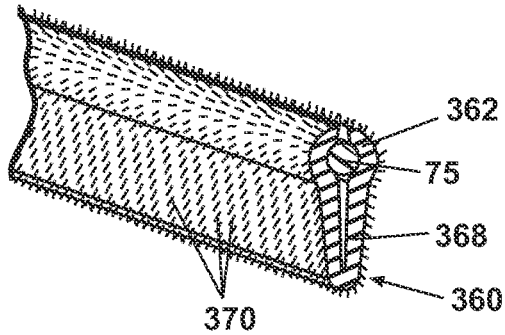
FIG. 7 is a partial perspective view of a hair collection element according to a fourth embodiment of the invention.

In yet another embodiment shown in FIG. 7 wherein like elements are identified by like reference numerals increased by 300, the hair collection element 360 is a blade 368 formed of the hair collecting material 370. The hair collecting material 370 comprises a directional fabric, which can optionally comprise a stiff backing (not shown) for enhancing structural rigidity of the blade 368. The blade 368 comprises an elongate strip of hair collecting material 370 that is folded along its longitudinal axis to form a lower end adapted to contact the cleaning surface. The upper end of the blade can be attached to an elongate pin 75 via adhesive, heat staking, or other conventional attachment means, thus forming an elongated cylindrical support 362 for pivotally mounting the blade 368 to the mounting slots 58 that extend downwardly within the suction nozzle 54.

A retainer cover 80 is adapted to be mounted at the upper edge 26 of the coupling housing 24 to define a cavity therein. The retainer cover 80 is substantially hollow and can have a generally half-cylindrical shape with a longitudinal axis oriented parallel to that of the upper housing 14. An upper surface of the retainer cover 80 can slope slightly upward along the longitudinal axis and toward the center of the retainer cover 80. The retainer cover 80 is secured to the coupling housing 24 by inserting conventional fasteners, such as screws 82, through the bosses 50 and into corresponding bosses 84 (FIG. 3) extending downwardly from a lower surface of the retainer cover 80. Alternatively, the retainer cover 80 and coupling housing 24 can be coupled in any suitable manner, such as by a snap fit, an adhesive, or the like.

As shown in FIGS. 3-4, the retainer cover 80 further includes downwardly-extending divider walls 85 that are substantially identical to the divider walls 28 and are adapted to align with the divider walls 28 when the retainer cover 80 is secured to the coupling housing 24 over the recesses 30, 32. The divider walls 85 also include notches (not shown) identical to the notches 34 of the coupling housing 24. Together the divider wall notches and coupling housing notches 34 are adapted to align to form, in effect, a hole or circular opening for receiving a peg, to be described hereinafter. The retainer cover 80 further comprises a cutout 86 that, together with the cutout 38, forms a coupling opening 88 (FIG. 1) at a rear of the vacuum accessory tool 10. The coupling opening 88 comprises an elongated opening having rounded ends and is adapted to enable the pivotal movement of a pivoting conduit 90 therein.

Referring again to FIG. 2, the pivoting conduit 90 comprises a hollow and substantially cylindrical elongated conduit member 92 adapted to fluidly couple to a source of suction (not shown) via a suction outlet 93 at an upper end thereof. As a non-limiting example, the source of suction can be a conventional suction hose or wand assembly of a conventional vacuum or suction cleaner. The pivoting conduit 90 further comprises a pivoting coupler 94 in the form of a hollow and generally cylindrical member oriented perpendicularly to and formed at a lower end of the elongated conduit member 92. The hollow interior of the pivoting coupler 94 is in fluid communication with the hollow interior of the elongated conduit member 92 to form a portion of the suction path therethrough. The pivoting coupler 94 further comprises a pair of pegs 96, each extending outwardly at longitudinally opposite sides thereof. The conduit coupler 94 further comprises conduit inlet 98 at a lower end thereof which is configured to be positioned adjacent the suction opening 46 opposite the suction opening 48.

When the vacuum accessory tool 10 is assembled, the pivoting coupler 94 is placed substantially within the coupling recess 32 with the pegs 96 being placed in the notches 34 and the elongated conduit member 92 extending rearwardly. The retainer cover 80 is secured to the coupling housing 24 in a manner enabling the rotation of the pivoting coupler 94 and pegs 96 therein. The elongated conduit member 92 extends through the coupling opening 88 and can be pivoted within the coupling opening 88 about an axis through the pegs 96. The conduit inlet 98 also aligns at least partially with the suction openings 46 and 48 such that the suction path can flow from the suction nozzle 54, through the suction opening 48 in the lower housing 16, through the suction opening 46 in the upper housing 14, through the conduit inlet 98, and through the suction outlet 93 to the suction source.

In operation, the accessory tool 10 is pushed and pulled in reciprocating fashion across a surface to be cleaned using a conventional hose or wand assembly that is fluidly connected to the pivoting conduit 90 at the suction outlet 93. The hair collection element 60 pivots back and forth within the angular pivot range between the two positions at the pivot limits shown in FIGS. 3 and 4, depending on the direction of movement of the vacuum accessory tool 10 across the surface being cleaned. When the accessory tool 10 is subjected to a pull stroke in the rearward direction shown by the arrow "R", the hair collection element 60 pivots to a forward position toward the front of the lower housing 16 and forms an acute forward angle relative to the cleaning surface as illustrated in FIG. 3. The hair collecting material 70 is oriented to collect hair and/or other small debris from the surface being cleaned. When the direction of movement of the accessory tool 10 is changed from the rearward direction "R" to the forward direction shown by the arrow "F", the hair collection element 60 pivots rearwardly to a rearward position toward the rear of the lower housing 16 and forms an acute backward angle relative to the cleaning surface as illustrated in FIG. 4. The hair collecting material 70 releases any previously collected hair and debris and is simultaneously oriented so as to not collect hair and/or other small debris during the forward stroke. The released debris pile resting within the suction nozzle 54 is then ingested through the suction openings 46, 48 (FIG. 2) and the conduit inlet 98 into the suction path and to the suction source via the pivoting conduit 90.

While the invention has been specifically described in connection with certain specific embodiments thereof, it is to be understood that this is by way of illustration and not of limitation, and the scope of the appended claims should be construed as broadly as the prior art will permit. Reasonable variation and combination are possible within the foregoing disclosure without departing from the spirit of the invention which is defined in the appended claims.

What is claimed is:

1. An accessory tool for use with a suction source comprising:

a housing comprising a suction outlet and a suction nozzle opening defined by a rim on an underside of the housing, the suction outlet being adapted to be coupled to the suction source; and a hair collection element pivotally mounted within the suction nozzle opening for movement between a forward position and a rearward position and adapted to contact a surface to be cleaned and to collect hair from the surface during movement of the suction nozzle along the surface at least in one direction, and the hair collection element is positioned within the suction nozzle opening so that the suction nozzle opening is in fluid communication with the suction outlet forwardly and rearwardly of the hair collection element regardless of the position of the hair collection element;

wherein the hair collecting element is configured to pick up hair during one of the forward and backward strokes and is adapted to release hair picked up by the hair collection element during the other of the forward and backward stroke for ingestion by the suction nozzle; and wherein the suction nozzle is configured to ingest the released hair during the other of the forward and backward stroke.

2. The accessory tool of claim 1 wherein the hair collection element in the form of a blade that has a thin cross-sectional profile and a longitudinal axis along its length, and the hair collection element is mounted for pivotal movement about the longitudinal axis.

3. The accessory tool of claim 2 wherein the hair collection element comprises a strip of directional fabric adapted to collect hair from the surface to be cleaned when the accessory tool is moved across the surface to be cleaned in a first direction and adapted to deposit collected hair from the surface to be cleaned for ingestion by the suction nozzle opening when the accessory tool is moved across the surface to be cleaned in a second direction.

4. The accessory tool of claim 3 wherein the strip of directional fabric is mounted to a surface of the blade.

5. The accessory tool of claim 3 wherein the directional fabric is folded along a length thereof to form the blade.

6. The accessory tool of claim 2 wherein the hair collection element comprises an elastomeric material that is adapted to collect hair from the surface during movement of the suction nozzle along the surface at least in one direction.

7. The accessory tool of claim 6 wherein the elastomeric material is coated onto the blade.

8. The accessory tool of claim 6 wherein the elastomeric material forms the hair collection element.

9. The accessory tool of claim 2 wherein the longitudinal axis is along one longitudinal edge of the profile so that the hair collection element is mounted substantially vertically within the suction nozzle opening.

10. The accessory tool of claim 9 wherein the hair collection element in the forward position forms an acute forward angle with respect to the surface to be cleaned during a backward stroke of the accessory tool and the hair collection element in the rearward position forms an acute backward angle with respect to the surface to be cleaned during a forward stroke.

11. The accessory tool of claim 10 wherein the hair collection element is configured within the suction nozzle to project beneath the rim of the suction nozzle in both the forward and backward strokes.

12. An accessory tool for use with a suction source comprising:

a housing comprising a suction outlet and a suction nozzle opening defined by a rim on an underside of the housing, the suction outlet being adapted to be coupled to the suction source; and a hair collection element mounted within the suction nozzle opening and comprising a hair collecting material that is adapted to contact a surface to be cleaned and to pick up hair during one of the forward and backward strokes of the suction nozzle and that is adapted to release hair picked up by the hair collecting material during the other of the forward and backward strokes of the suction nozzle for ingestion by the suction nozzle, and the hair collection element is positioned within the suction nozzle opening so that the suction nozzle opening is in fluid communication with the suction outlet forwardly and rearwardly of the hair collection element regardless of the position of the hair collection element;

wherein the hair collection element has a thin cross-sectional profile and a longitudinal axis along its length, and the hair collection element is mounted substantially vertically within the suction nozzle opening; and wherein the suction nozzle is configured to ingest the released hair during the other of the forward and backward strokes.

13. The accessory tool of claim 12 wherein the hair collecting material is a directional fabric that is adapted to pick up hair only when the suction nozzle moves in only one of the forward and backward strokes and not in the other of the forward and backward strokes.

14. The accessory tool of claim 13 wherein the hair collection element is pivotally mounted within the suction nozzle opening for movement between a forward position and a rearward position as the suction nozzle moves along the surface to be cleaned between the forward and backward strokes.

* * * * *